US006768412B2

(12) United States Patent
Becka et al.

(10) Patent No.: US 6,768,412 B2
(45) Date of Patent: Jul. 27, 2004

(54) SNAP ACTION THERMAL SWITCH

(75) Inventors: Stephen F. Becka, North Bend, WA (US); George D. Davis, Bellevue, WA (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/223,943

(22) Filed: Aug. 20, 2002

(65) Prior Publication Data

US 2003/0034870 A1 Feb. 20, 2003

Related U.S. Application Data

(60) Provisional application No. 60/313,789, filed on Aug. 20, 2001.

(51) Int. Cl.[7] ..... H01H 37/52; H01H 37/54

(52) U.S. Cl. ..... 337/36; 337/53; 337/89; 337/365; 251/129.02

(58) Field of Search ..... 337/36, 139, 333, 337/140, 14, 16, 52, 53, 85, 89, 362, 365; 251/129.02

(56) References Cited

U.S. PATENT DOCUMENTS

| | | | | |
|---|---|---|---|---|
| 2,798,130 A | * | 7/1957 | Cox | 200/83 B |
| 4,826,131 A | * | 5/1989 | Mikkor | 251/129.17 |
| 5,058,856 A | * | 10/1991 | Gordon et al. | 251/11 |
| 5,065,978 A | | 11/1991 | Albarda et al. | |
| 5,164,558 A | | 11/1992 | Huff et al. | |
| 5,325,880 A | * | 7/1994 | Johnson et al. | 137/1 |
| 5,452,878 A | * | 9/1995 | Gravesen et al. | 251/129.02 |
| 5,463,233 A | | 10/1995 | Norling | 257/254 |
| 5,467,068 A | * | 11/1995 | Field et al. | 335/4 |
| 5,536,963 A | * | 7/1996 | Polla | 257/417 |
| 5,650,568 A | | 7/1997 | Greiff et al. | 73/504.09 |
| 5,681,024 A | * | 10/1997 | Lisec et al. | 251/11 |
| 5,771,321 A | * | 6/1998 | Stern | 385/31 |
| 6,100,477 A | * | 8/2000 | Randall et al. | 200/181 |
| 6,143,583 A | | 11/2000 | Hays | 438/39 |
| 6,182,941 B1 | * | 2/2001 | Scheurenbrand et al. | 251/129.04 |
| 6,188,301 B1 | * | 2/2001 | Kornrumpf et al. | 333/262 |
| 6,239,685 B1 | * | 5/2001 | Albrecht et al. | 337/365 |
| 6,355,534 B1 | * | 3/2002 | Cheng et al. | 438/379 |
| 6,359,374 B1 | * | 3/2002 | Dausch et al. | 310/330 |
| 6,391,675 B1 | * | 5/2002 | Ehmke et al. | 438/53 |
| 6,504,447 B1 | * | 1/2003 | Laney et al. | 333/17.2 |
| 6,561,224 B1 | * | 5/2003 | Cho | 137/831 |

FOREIGN PATENT DOCUMENTS

| | | |
|---|---|---|
| EP | 0 709 911 | 5/1996 |
| FR | 2 772 512 | 6/1999 |
| WO | WO 99/22390 | 5/1999 |
| WO | WO 00/44012 | 7/2000 |

* cited by examiner

*Primary Examiner*—Anatoly Vortman
(74) *Attorney, Agent, or Firm*—Charles J. Rupnick

(57) ABSTRACT

A simplified snap-action micromachined thermal switch having a bimodal thermal actuator fabricated from non-ductile materials such as silicon, glass, silicon oxide, tungsten, and other suitable materials using MEMS techniques.

28 Claims, 7 Drawing Sheets

SNAP ACTION THERMAL SWITCH

This application claims the benefit of U.S. Provisional Application Serial No. 60/313,789, filed in the names of Stephen F. Becka and George D. Davis on Aug. 20, 2001, the complete disclosure of which is incorporated herein by reference.

FIELD OF THE INVENTION

The present invention relates to snap action thermal measurement devices and methods, and in particular to snap action thermal measurement devices formed as micromachined electromechanical structures (MEMS).

BACKGROUND OF THE INVENTION

Various temperature sensors are known in the art. Such sensors are used in various measurement and control applications. For example, thermocouples, resistive thermal devices (RTDs) and thermistors are used for measuring temperature in various applications. Such sensors provide an electrical analog signal, such as a voltage or a resistance, which changes as a function of temperature. Monolithic temperature sensors are also known. For example, a diode connected bipolar transistor can be used for temperature sensing. More specifically, a standard bipolar transistor can be configured with the base and emitter terminals shorted together. With such a configuration, the base collector junction forms a diode. When electrical power is applied, the voltage drop across the base collector junction varies relatively linearly as a function of temperature. Thus, such diode connected bipolar transistors have been known to be incorporated into various integrated circuits for temperature sensing.

Although the above described devices are useful in providing relatively accurate temperature measurements, they are generally not used in control applications to control electrical equipment. In such control applications various types of precision thermostats are used. The thermal switch is one form of precision thermostat used in control applications to switch on or off heaters, fans, and other electrical equipment at specific temperatures. Such temperature switches typically consist of a sensing element which provides a displacement as a function of temperature and a pair of electrical contacts. The sensing element is typically mechanically interlocked with the pair of electrical contacts to either make or break the electrical contacts at predetermined temperature set points. The temperature set points are defined by the particular sensing element utilized.

Various types of sensing elements are known which provide a displacement as a function of temperature. For example, mercury bulbs, magnets and bimetallic elements are known to be used in such temperature switches.

Mercury bulb thermal sensors have a mercury filled bulb and an attached glass capillary tube which acts as an expansion chamber. Two electrical conductors are disposed within the capillary at a predetermined distance apart. The electrical conductors act as an open contact. As temperature increases, the mercury expands in the capillary tube until the electrical conductors are shorted by the mercury forming a continuous electrical path. The temperature at which the mercury shorts the electrical conductors is a function of the separation distance of the conductors.

Magnetic reed switches have also been known to be used as temperature sensors in various thermal switches. Such reed switch sensors generally have a pair of toroidal magnets separated by a ferrite collar and a pair of reed contacts. At a critical temperature known as the Curie point, the ferrite collar changes from a state of low reluctance to high reluctance to allow the reed contacts to open.

Mercury bulb and magnetic reed thermal switches have known problems associated with them. More specifically, many of such switches are generally known to be intolerant of external forces, such as vibration and acceleration forces. Consequently, such thermal switches are generally not suitable for use in various applications, for example, in an aircraft.

Bi-metallic thermal switch elements typically consist of two strips of materials having different rates of thermal expansion fused into one bi-metallic disc-shaped element. Precise physical shaping of the disc element and unequal expansion of the two materials cause the element to change shape rapidly at a predetermined set-point temperature. The change in shape of the bi-metal disc is thus used to activate a mechanical switch. The bimetallic disc element is mechanically interlocked with a pair of electrical contacts such that the rapid change in shape can be used to displace one or both of the electrical contacts to either make or break an electrical circuit.

The critical bimetallic disc element is difficult to manufacture at high yield with predictable thermal switching characteristics. This unpredictability results in a need for costly, extensive testing to determine the set-point and hysteretic switching characteristics of each individual disc element. In addition, because the bi-metallic disc elements are fabricated by stressing a deformable or ductile metal beyond its elastic limit, which permanently deforms the material. The material, when the stress is removed, slowly relaxes toward its pre-stressed condition, which alters the temperature response characteristics. Thus, drift or "creep" in the temperature switching characteristics can result over time. Next generation markets for thermal switches will require products with increased reliability and stability.

Furthermore, the bi-metallic disc element is by nature relatively large. Therefore, these thermal switches are relatively large and are not suitable for use in various applications where space is rather limited. Next generation thermal switches will require a reduction in size over the current state of the art.

Moreover, thermal switches actuated by the various sensing elements discussed above are normally assembled from discrete components. As such, the assembly cost of such temperature switches increases the overall manufacturing cost.

Another problem with such known thermal switches relates to calibration. More specifically, such known thermal switches generally cannot be calibrated by the end user. Thus, such known temperature switches must be removed and replaced if the calibration drifts, which greatly increases the cost to the end user.

Monolithic micromachined thermal switches have been developed in the past that obviate the necessity of assembling discrete components. These monolithic micromachined structures also allow the thermal switch to be disposed in a relatively small package. One example is a thermal switch described by co-owned U.S. Pat. No. 5,463,233 entitled, MICROMACHINED THERMAL SWITCH, issued to Brian Norling on Oct. 31, 1995, which is incorporated herein by reference, wherein a thermal switch includes a bi-metallic cantilever beam element operatively coupled to a pair of electrical contacts. A biasing force such as an electrostatic force is applied to the switch to provide snap action of the electrical contacts in both the opening and closing directions which enables the temperature set point to be adjusted by varying electrostatic force biasing voltage.

Although many of these known thermal switches are useful and effective in current applications, next generation applications will require products of reduced size with increased reliability and stability beyond the capabilities of the current state of the art.

SUMMARY OF THE INVENTION

The present invention provides a small and inexpensive snap action thermal measurement device which can retain its original set point over long operating life and large temperature excursions by providing a thermal switch actuator fabricated from non-ductile materials, in contrast to the prior art devices and methods.

The apparatus and method of the present invention provide a simplified snap-action micromachined thermal switch that eliminates any requirement for electrical bias to prevent arcing. The apparatus of the invention is a thermal switch actuator fabricated from non-ductile materials such as silicon, glass, silicon oxide, tungsten, and other suitable materials using MEMS techniques that replaces the bimetallic disc thermal actuator described above. The use of non-ductile materials solves the lifetime creep problems, while the use of MEMS manufactured sensors addresses size and cost issues. The resulting thermal switch is alternatively configured to drive a solid state relay or a transistor.

According to one aspect of the invention, the bimodal thermal actuator includes an actuator base structure formed of a first substantially non-ductile material having a first coefficient of thermal expansion, the actuator base structure being formed with a relatively mobile portion and a substantially stable mounting portion extending therefrom; a cooperating thermal driver structure formed of a second substantially non-ductile material and having a second coefficient of thermal expansion different from the first coefficient of thermal expansion, the thermal driver structure being joined to at least a portion of the mobile portion of the actuator base structure; and an electrical conductor portion formed on the mobile portion of the actuator base structure.

According to another aspect of the invention, at least one of the first and second substantially non-ductile materials of the bimodal thermal actuator is selected from a family of materials having a high ultimate strength and a high shear modulus of elasticity.

According to another aspect of the invention, the mobile portion of the actuator base structure of the bimodal thermal actuator is formed in an arcuate shape.

According to another aspect of the invention, the cooperating thermal driver structure of the bimodal thermal actuator is formed as a thin layer of the second substantially non-ductile material joined to the mobile portion of the actuator base structure adjacent to the substantially stable mounting portion thereof.

According to another aspect of the invention, the electrical conductor portion of the bimodal thermal actuator is formed as a portion of the mobile portion that is doped with electrically conductive material.

According to another aspect of the invention, the electrical conductor portion of the bimodal thermal actuator is formed as a metallic electrode at a central portion of the mobile portion.

According to another aspect of the invention, the invention provides a micromachined thermal switch that further includes a support base having an upright mesa and an electrode formed on one surface; and the mounting portion of the bimodal thermal actuator is coupled to the mesa with the electrical conductor portion of the mobile portion aligned with the electrode on the support base. According to other aspects of the invention, the support base includes two upright mesas with the electrode formed on the surface in between. The bimodal thermal actuator is suspended from the two mesas with the electrical conductor portion provided at the center of the mobile portion in alignment with the electrode on the support base.

According to still other aspects of the invention, the invention provides a method for determining temperature, the method providing joining together two substantially non-ductile materials having different coefficients of thermal expansion along a common surface in a bimodal thermal actuator having an actuator portion being mobile relative to a mounting portion and having an electrically conductive area situated at one surface thereof; and wherein the relatively mobile actuator portion is further disposed subsequently in a plurality of stable relationships to the mounting portion as a function of sensed temperature, a first stable relationship of the relatively mobile actuator portion to the mounting portion positioning the electrically conductive area in contact with an electrode, and a second stable relationship of the relatively mobile actuator portion to the mounting portion spacing the electrically conductive area away from the electrode.

According to another aspect of the method of the invention, the first stable relationship places the electrically conductive area of the relatively mobile actuator portion on a first side of the mounting portion, and the second stable relationship places the electrically conductive area of the relatively mobile actuator portion on a second side of the mounting portion opposite from the first side.

According to another aspect of the method of the invention, the method further provides joining the mounting portion of the bimodal thermal actuator in relationship to a support structure including the electrode.

According to yet another aspect of the method of the invention, the method further provides forming the relatively mobile actuator portion in an arcuate configuration extending from the mounting portion.

According to still another aspect of the method of the invention, the method further provides forming the mounting portion as a pair of spaced apart mounting portions; and forming the relatively mobile actuator portion in an arcuate configuration extending between the pair of spaced apart mounting portions.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF PREFERRED EMBODIMENT

In the Figures, like numerals indicate like elements.

The present invention is an apparatus and method for a small and inexpensive snap action thermal measurement device having a bimodal thermal actuator in combination with a support plate being formed with one or more upright mesas and an electrical contact, wherein the bimodal thermal actuator is joined to the one or more mesas of the support plate with an electrically conductive portion being aligned with the electrical contact of the support plate such that, as a function of sensed temperature, the electrically conductive portion is either spaced away from the electrical contact of the support plate or making an electrical connection with the electrical contact.

The bimodal thermal actuator is a bi-stable element having an actuator base structure formed of a first substantially non-ductile material having a first coefficient of thermal expansion, and having a relatively mobile portion and a substantially stable mounting portion extending therefrom; a cooperating thermal driver structure formed of a second substantially non-ductile material and having a second coefficient of thermal expansion different from the first coefficient of thermal expansion, the thermal driver structure being joined to at least a portion of the mobile portion of the actuator base structure; and the electrical conductive portion formed on the mobile portion of the actuator base structure.

The figures illustrate the thermal actuation device of the present invention embodied as a bimodal snap action thermal actuation device for driving a thermal measurement micro-machined electromechanical sensor (MEMS) 10.

Figure 1:
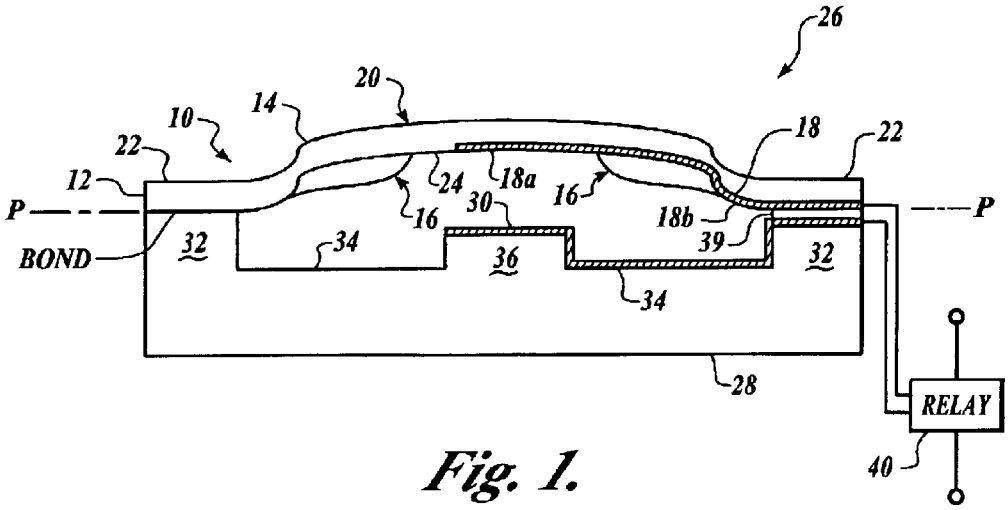
FIG. 1 is an illustration of the bimodal thermal actuation device of the invention embodied as a multilayered thermal actuator configured in a first state of stability.
Figure 2:
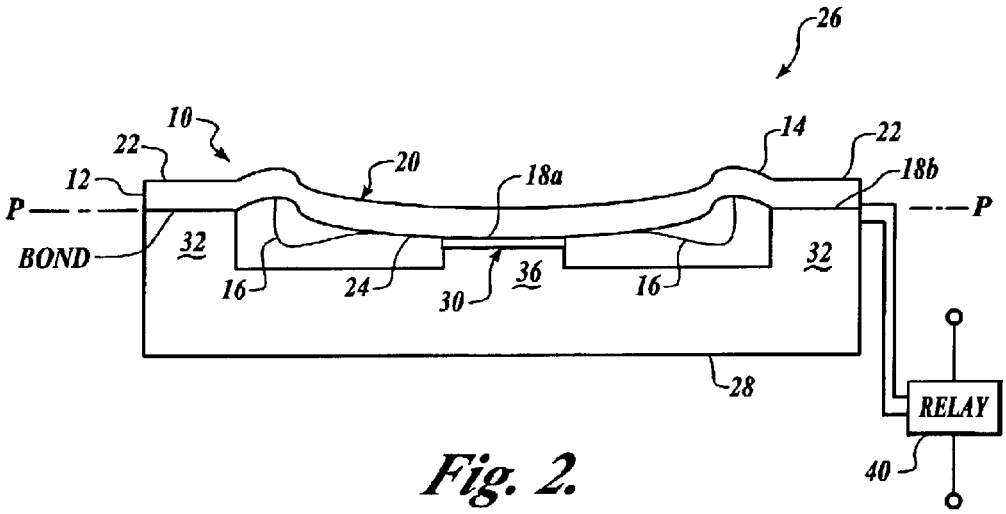
FIG. 2 illustrates the bimodal thermal actuation device of the invention embodied as the multilayered thermal actuator shown in FIG. 1 and configured in a second state of stability that is inverted from the first state.

FIGS. 1 and 2 illustrate the bimodal thermal actuation device of the invention embodied as a thermal actuator 12 that is formed of a combination of materials having different thermal response characteristics. Each of the components of the bimodal thermal actuator 12 is formed of a strong and substantially non-ductile material that is selected from a family of materials having a high tensile or ultimate strength and a high shear modulus of elasticity, also known as the modulus of rigidity. In other words, the materials utilized in forming the component parts of the thermal actuator 12 exhibit very small plastic deformation or strain under high stress loads and return to a pre-stressed condition or shape when the distorting stress is relaxed or removed. In contrast, traditional bimetallic thermal actuators are known to make use of ductile materials, which undergo relatively large plastic deformation or elongation under stress and therefore retain some deformation after the distorting stress is relaxed, and are therefore subject to continued relaxation over time and use. The materials suitable for use in forming the bimodal thermal actuator 12 of the invention are therefore non-ductile materials including, for example, silicon, glass, silicon oxide, tungsten and other materials having a suitably high shear modulus of elasticity.

According to one embodiment of the invention, the bimodal thermal actuation device or thermal actuator 12 of the invention includes a thin, bent or shaped actuator base structure 14 in combination with a cooperating thermal driver structure 16 and an electrical conductor portion 18. The material of the base structure 14 is selected from the family of strong and substantially non-ductile materials discussed above and having a first or base thermal expansion rate. For example, the base material is epitaxial silicon or another suitable non-ductile material that is configurable using known microstructuring techniques. Using one of a number of processing techniques discussed below, the bent or shaped base structure 14 is, for example, a thin beam, sheet, disc or other suitable shape that is initially shaped into a central mobile arcuate actuator portion 20 that is bordered by a substantially planar mounting flange 22 at its outer or peripheral edge and has an inner or concave surface 24 that is spaced a distance away from the plane P of the border portion 22.

The cooperating driver structure 16 is a portion of thermal driver material that is in intimate contact with the inside or concave surface 24 of the arched or curved actuator portion 20 of the base structure 14. For example, the thermal driver material is deposited or otherwise bonded or adhered in a thin layer at a peripheral portion of the inside portion of the arch 20 adjacent to the mounting flange 22 at the outer edge of the base structure 14. The thermal driver material is another material selected from the family of strong and substantially non-ductile materials having a high shear modulus of elasticity and being suitable for use in forming the base structure 14, as discussed above. Furthermore, the driver material is different from the particular material used in forming the base structure 14 and has a second or driver thermal coefficient of expansion that results in a drive thermal expansion rate different from the base thermal expansion rate. For example, when the base structure 14 is formed of silicon, the driver structure 16 is formed of silicon oxide, silicon nitride, tungsten or another suitable material selected from the above discussed family of strong and substantially non-ductile materials and having a thermal coefficient of expansion different from silicon.

According to the embodiment of the invention illustrated in FIGS. 1 and 2, the mobile arched or curved actuator portion 20 of the base structure 14 is constrained at its outer border portion 22, which is, for example, the two ends of a beam-shaped base structure or a peripheral hoop portion of a disc-shaped base structure. During a change in the ambient temperature of the bimodal thermal actuator 12, the different thermal expansion characteristics of the dissimilar base and driver materials combine with the constraining forces at the border portion 22 to generate stresses that force the base structure 14 to change from a first state of stability, as illustrated in FIG. 1, to a second state of stability that is inverted from the first state, as illustrated in FIG. 2. The stresses thus generated by the differential expansion and constraining forces cause the mobile central arch portion 20 to change shape, i.e., flatten. As the ambient temperature increases, the stress applied by the difference in thermal expansion between the base and driver materials increases until, at a predetermined set-point operation temperature, the stress is so great that the arch portion 20 of the base structure 14 "snaps through" past the border portion 22 to an "inverted" arched or curved shape, as shown in FIG. 2. The central actuator portion 20 of the bimodal thermal actuator 12 is thus relatively mobile as a function of sensed temperature with respect to the substantially stable mounting flange 22 along its border.

The thermal actuator 12 is alternatively configured for operation at a set-point operation temperature that is either above or below room ambient temperature. Assuming the thermal actuator 12 is intended for operation at a set-point temperature above ambient temperature, the actuator base structure 14 is the low expansion rate portion and is formed of a material having a lower thermal expansion coefficient, and the thermal driver structure 16 is the high expansion rate portion and is formed of a driver material having a thermal expansion coefficient higher than that of the base structure 14. If, on the other hand, the thermal actuator 12 is intended for operation at a set-point temperature below room ambient temperature, the thermal actuator 12 is formed oppositely with the base structure 14 formed of the higher expansion rate material and being the high expansion portion, while the driver structure 16 is the low expansion rate portion and is formed of a driver material having a thermal expansion coefficient lower than that of the base structure 14. For purposes of explanation only, the thermal actuator 12 is described herein to be intended for operation at a set-point temperature above room ambient temperature. Accordingly, at a temperature below the upper set-point temperature the thermal actuator 12 is configured, as shown in FIG. 1, with the central arched portion 20 in an upwardly concave state and with the surface 24 being an inner concave surface. As discussed above, the upwardly concave configuration illustrated in FIG. 1 is considered for explanatory purposes to be the first state of stability.

As the temperature of the thermal actuator 12 is raised to approach its upper set-point operating temperature, the high expansion rate driver material of the driver structure 16 begins to stretch, while the lower expansion rate base material of the actuator base structure 14 remains relatively stable. As the high expansion rate driver material expands or grows, it is restrained by the relatively more slowly changing lower expansion rate base material and the constraint imposed at the periphery 22. Both the higher and lower expansion rate portions 16, 14 of the thermal actuator 12 become strained and distorted by the thermally induced stresses and the constraint maintained by the outer mounting portion 22.

As the temperature of the thermal actuator 12 reaches its upper predetermined set-point temperature of operation, the central mobile arched or curved portion 20 of the base structure 14 moves with a snap-action downward through the constrained outer mounting portion 22 to the second state of stability wherein the inner concave surface 24 of the central mobile portion 20 is inverted to an outer convex surface 24 spaced a distance away from the plane P on the opposite side of the border flange 22, as illustrated in FIG. 2.

As the temperature of the thermal actuator 12 is reduced form the high temperature toward a lower predetermined set-point temperature of operation, the driver material of the driver structure 16 having the relatively larger thermal coefficient also contracts or shrinks more rapidly than the base material of the base structure 14 having the relatively smaller thermal coefficient.

As the high expansion rate driver material contracts, it is restrained by the relatively more slowly changing lower expansion rate base material. Both the higher and lower expansion rate portions 16, 14 of the thermal actuator 12 become strained and distorted by the thermally induced stresses and the constraint maintained by the outer mounting portion 22. As the thermal actuator 12 reaches the lower set-point temperature, the central stretched portion 20 snaps back through the constrained outer mounting portion 22 to the first state of stability, as illustrated in FIG. 1.

The use of non-ductile materials obviates the lifetime creep problems associated with some traditional bi-metallic thermal actuators that utilize relatively ductile materials for both the base and driver materials. The high shear modulus of elasticity or modulus of rigidity of non-ductile materials ensure that no component of the bimodal thermal actuator 12 of the invention is stressed beyond its yield point. The structure of the bimodal thermal actuator 12 thus returns to its pre-stressed condition or shape when the distorting stress is relaxed or removed.

As illustrated in FIGS. 1 and 2, the characteristic of the thermal actuator 12 of snapping into a different state of concavity at a predetermined threshold or set-point temperature is used in a thermal switch to open or close an electrical contact or other indicator to signal that the set-point has been reached. The speed at which the bi-metallic disc actuator 12 changes state is commonly known as the "snap rate." The change from one bi-stable state to the other is not normally instantaneous, but is measurable. A slow snap rate means that the state change occurs at a low rate of speed, while a fast snap rate means that the state change occurs at a high rate of speed. A slow snap rate is a problem associated with some of the traditional bimetallic thermal actuators of the prior art. Accordingly, use of some known bimetallic thermal actuators in electrical switches and indicator devices result in a slow snap rate that causes arcing between the operative electrical contacts. Slow snap rates thus limit the current carrying capacity of the thermal switch or indicator device. In contrast, a fast snap rate means that the change in state occurs rapidly, which increases the amount of current the thermal switch or indicator device can carry without arcing. The temperature rate of change affects the snap rate. A slower temperature rate of change tends to slow the snap rate, while a faster temperature rate of change usually results in a faster snap rate. While some applications provide fast temperature rates, switches and indicators experience very slow temperature rates in many other applications. In some applications, the temperature rates may be as low as about 1 degree F. per minute or less. For long-term reliability the device must operate in these very slow temperature application rates without arcing. The use of non-ductile materials for both the base and driver materials of the thermal actuator 12 of the invention obviates this creep aspect of some traditional bi-metallic thermal actuators.

According to the embodiment of the invention illustrated in FIGS. 1 and 2, the thermal actuator 12 of the invention is provided in a simplified snap-action micromachined thermal switch 26. When the thermal actuator 12 of the invention is practiced in the thermal switch 26, in this second inverted configuration the electrical conductor portion 18 of the arch 20 is presented for contact with one or more electrical contacts formed in a micromachined support plate 28. The thermal actuator 12 is thus provided in combination with the micromachined support plate 28 having one or more electrical contacts 30 coupled for transmitting an electrical signal. The support 28 is, for example, formed in a substantially planar structure, i.e., a substrate having substantially planar and parallel opposing offset upper and lower surfaces. The substrate may be formed of almost any material, including a material selected from the family of strong and substantially non-ductile materials discussed above, which includes at least silicon, glass, silicon oxide, tungsten. For example, the support plate material is glass or another suitable non-ductile material that is configurable using known microstructuring techniques. Furthermore, the support plate material is optionally formed of a material having a thermal expansion rate similar to or approximately the same as the thermal expansion rate of the actuator base material of which the actuator base structure 14 of the thermal actuator 12 is formed, so that the thermal expansion characteristics of the support 28 do not interfere with or adversely affect the operation of the thermal actuator 12. Thus, according to one embodiment of the invention, the support 28 is formed of a monocrystalline silicon material in a substantially planar structure, similar to the base material used to form the base structure 14 of the thermal actuator 12. According to another embodiment of the invention, the support 28 is formed of a glass material, such as Pyrex RTM glass.

The support plate 28 is formed with mesas 32 projecting above an inner surface or floor 34 on either side of the contact 30. The contact 30 may be formed atop another mesa 36 similarly projecting above the floor 34, but to a lesser height than the flanking or surrounding mesas 32. One or more conductive traces 38 are formed on the inner surface of the support 28 at the floor 34. Alternatively, the support 28 is doped with an electrically conductive material such as boron, indium, thallium, or aluminum, or is formed of a semiconductor material, such as silicon, gallium arsenide, germanium, or selenium.

The thermal actuator 12 is coupled to the support plate 28 such that the mobile center portion 20 of the base structure 14 is constrained at the outer border portion 22 to the mesas 32 of the support plate 28. The constraint is, for example, by conventional adhesive or chemical bonding. Connection to the mesas 32 thus provides the mechanical constraint at the outer mounting flange 22 that, as discussed above, operates in combination with thermally induced stresses to drive the mobile central portion 20.

In operation the electrical conductor portion 18 is used to make or break contact with the electrical contact 30 and thereby complete or interrupt an electrical circuit. The electrical conductor portion 18 is, for example, provided as a central electrode 18*a* and one or more conductive traces 18*b* formed on the inner concave surface 24 of the central mobile portion 20 of the actuator 12, with the conductive traces 18*b* led to the outer mounting portion 22 for connection in a circuit. Alternatively, the electrical conductor portion 18 is provided by suitably doping the actuator base structure 14 with an electrically conductive material such as boron, indium, thallium, or aluminum, or forming it of a semiconductor material, such as silicon, gallium arsenide, germanium, or selenium.

The thermal actuator 12 is coupled to the support plate 28 to present the electrode 18*a* of the mobile portion 20 for contact with the one or more electrical contacts 30 projecting above the floor 34. The electrode portion 18*a* of the electrical conductor portion 18 is aligned with each of the one or more electrical contacts 30 such that displacement of the mobile center portion 20 toward the support 28 brings the electrode 18*a* into contact with the electrical contact(s) 30, thereby closing an electrical circuit. According to one embodiment of the thermal switch 26 of the invention, the thermal actuator 12 includes electrical conduction means coupled between the central conductor portion 18 and one of the outer edge portions 22. For example, either one or more conductive traces 18*b* are formed on the inner surface of the base structure 14; or a portion of the base structure 14 is doped with electrically conductive material such as boron, indium, thallium, or aluminum. According to one embodiment of the invention, the base structure 14 is formed of a semiconductor material, such as silicon, gallium arsenide, germanium, or selenium. The top or table portion of the mesas 32 include a film or layer 39 of an electrically insulating material, such as silicon oxide, for electrically isolating the thermal actuator 12 from the support 28. The insulating layer 39 is provided between the conductive portion 38 of the support 28 and the conductive portion 18*b* of the thermal actuator 12. Else, the conductive portion 38 is recessed below the contact surface of the mesa 32.

FIG. 2 illustrates the thermal switch 26 having the thermal actuator 12 disposed in the second state of stability, whereby the inner concave surface 24 of the central mobile portion 20 is inverted to an outer convex surface 24 spaced a distance away from the plane P of the border portion 22. In this second inverted configuration the central mobile portion 20 and the electrode 18*a* portion of the electrical conductor portion 18 are forced into contact with the electrical contact 30 of the support structure 28, thereby closing a circuit. For example, circuit closure can be used directly to switch a small load, or can be used in conjunction with a switching means, such as a solid state relay 40 to switch large loads. Alternatively, a power transistor can be used for switching relatively large electrical currents. As discussed in more detail below, the temperature switch 26 is adapted to be formed by micromachining as a monolithic chip. As such, the solid state relay 40 discussed above and either the alternative power transistor or the field effect transistor (FET) discussed below can be easily and inexpensively incorporated on the same chip as the temperature switch 26 forming an integrated circuit.

Figure 3:
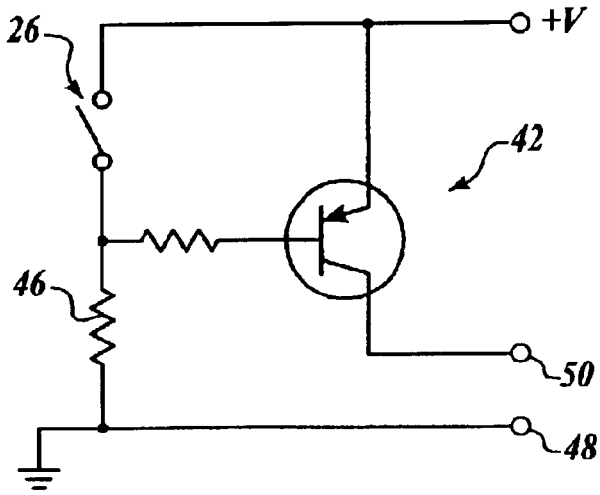
Fig. 3. (PRIOR ART)
FIG. 3 illustrates a schematic diagram of a bipolar transistor for use with the thermal switch of the invention.
Figure 4:
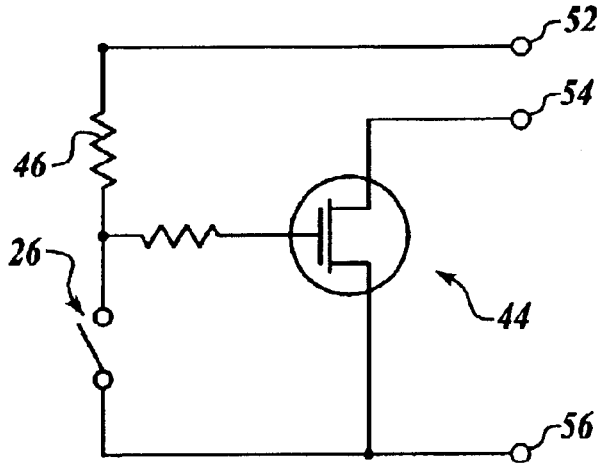
Fig. 4. (PRIOR ART)
FIG. 4 illustrates a schematic diagram of a field effect transistor (FET) for use with the thermal switch of the invention.

Accordingly, either a bipolar transistor 42, illustrated in FIG. 3, or a field effect transistor (FET) 44, illustrated in FIG. 4, can be incorporated into the same chip with the thermal switch 26. In FIG. 3, low side switching is accomplished by connecting the temperature switch 26, shown schematically, between the base of the bipolar transistor 42 and a positive voltage source, +V. An integrally formed current limiting resistor 46 may be connected between the base and the ground 48. In such an application the electrical current is switched by the power transistor 42 and not the temperature switch 26. In operation, when the temperature switch 26 closes, electrical current flows through the current limiting resistor 46 to turn on the power transistor 42. Thus, the switched output may be sensed between the terminals 50 and 48.

According to the alternative embodiment illustrated in FIG. 4, the temperature switch 26 is configured for high side switching a field effect transistor (FET) 44, which is incorporated into the same chip along with the temperature switch 26. Accordingly, the temperature switch 26 is connected between the gate and the drain terminal of the FET, while the current limiting resistor 46 is connected between the gate and an output terminal 52. In operation, as the temperature switch 26 closes, the voltage drop across the current limiting resistor 46 causes the power transistor 44 to turn ON. The switched output is between the terminals 52 and 54.

The thermal switch 26 can also be built upside-down, i.e., with the thermal actuator 12 inverted, to open a circuit at a predetermined elevated set-point temperature.

Miniaturization of mechanical and/or electromechanical systems has flourished in recent years as the manufacture of small lightweight micromachined electromechanical structures (MEMS) produced by semiconductor fabrication techniques has become generally well known. According to one embodiment of the present invention, the thermal switch 76 of the present invention is fabricated as a MEMS device using these well-known semiconductor fabrication techniques.

One example of the MEMS device fabrication process is described in U.S. Pat. No. 5,650,568 to Greiffet al., Gimballed Vibrating Wheel Gyroscope Having Strain Relief Features, which is incorporated herein by reference. The Greiff et al. '568 patent describes a Dissolved Wafer Process (DWP) for forming a lightweight, miniaturized MEMS gimballed vibrating wheel gyroscope device. The DWP utilizes conventional semiconductor techniques to fabricate the MEMS devices that form the various mechanical and/or electromechanical parts of the gyroscope. The electrical properties of the semiconductor materials are then used to provide power to the gyroscope and to receive signals from the gyroscope.

Figure 5A:
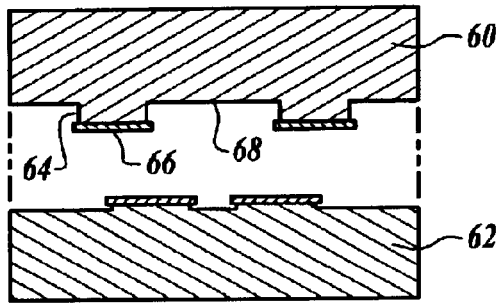
Fig. 5A. (PRIOR ART)
FIGS. 5A–5D illustrate a known Dissolved Wafer Process (DWP) for manufacturing MEMS devices using conventional semiconductor fabrication techniques.

FIGS. 5A–5D illustrate the DWP described in the Greiff et al. '568 patent for manufacturing MEMS devices using conventional semiconductor fabrication techniques. In FIG. 5A, a silicon substrate 60 and a support substrate 62 are shown. In a typical MEMS device, the silicon substrate 60 is etched to form the mechanical and/or electromechanical members of the device. The mechanical and/or electromechanical members are generally supported above the support substrate 62 such that the mechanical and/or electromechanical members have freedom of movement. This support substrate 62 is typically made of an insulating material, such as Pyrex RTM glass.

Support members 64 are initially etched from an inner surface 66 of the silicon substrate 60. These support members 64 are commonly known as mesas and are formed by etching, such as with potassium hydroxide (KOH), those portions of the inner surface 66 of the silicon substrate 60 that are exposed through an appropriately patterned layer of photoresist 68 until mesas 64 of a sufficient height have been formed.

Figure 5B:
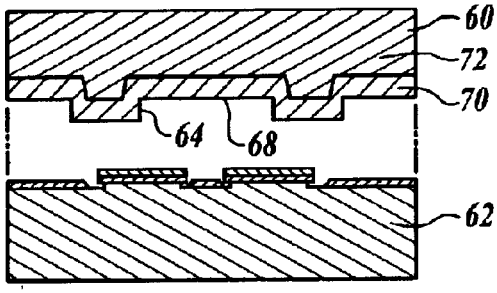
Fig. 5B. (PRIOR ART)
Figure 5C:
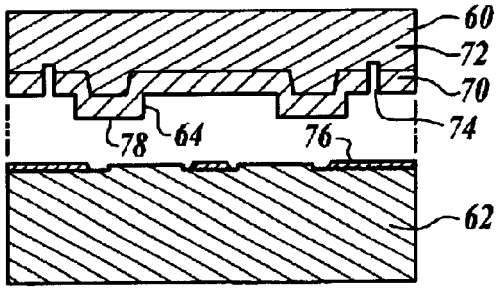
Fig. 5C. (PRIOR ART)

In FIG. 5B, the etched inner surface 66 of the silicon substrate 60 is thereafter doped, such as with boron, to provide a doped region 70 of a predetermined depth such that the silicon substrate 60 has both a doped region 70 and an undoped sacrificial region 72. In FIG. 5C, trenches 74 are then formed, such as by a reactive ion etching (RIE) or Deep-Reaction-Ion-Etching (DRIE) techniques, that extend through the doped region 70 of the silicon substrate 60. These trenches 74 form the mechanical and/or electromechanical members of the MEMS device.

The support substrate 62, as shown in FIGS. 5A–5C, is also initially etched and metal electrodes 76 and conductive traces (not shown), are formed on the inner surface of the support substrate 62. These electrodes 76 and conductive traces subsequently provide electrical connections to the various mechanical and/or electromechanical members of the MEMS device.

Figure 5D:
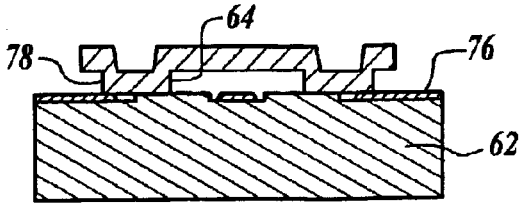
Fig. 5D. (PRIOR ART)

In FIG. 5D, after the support substrate 62 is processed to form the electrodes 76 and conductive traces, the silicon substrate 60 and the support substrate 62 are bonded together. The silicon and support substrates 60, 62 are bonded together at contact surfaces 78 on the mesas 64, such as by an anodic bond. The undoped sacrificial region 72 of the silicon substrate 60 is etched away such that only the doped region 70 that is the mechanical and/or electromechanical member of the resulting MEMS device remains. The mesas 64 that extend outwardly from the silicon substrate 60 therefore support the mechanical and/or electromechanical members above the support substrate 62 such that the members have freedom of movement. Further, the electrodes 76 formed on the support substrate 62 provide an electrical connection to the mechanical and/or electromechanical members through the contact of the mesas 64 with the electrodes 76.

Another example of the DWP for fabricating a MEMS device is described in U.S. Pat. No. 6,143,583 to Hays, Dissolved Wafer Fabrication Process And Associated Microelectromechanical Device Having A Support Substrate With Spacing Mesas, which is incorporated herein by reference. The method of the Hays '583 patent permits fabrication of MEMS devices having precisely defined mechanical and/or electromechanical members by maintaining the planar nature of the inner surface of the partially sacrificial substrate such that the mechanical and/or electromechanical members can be separated or otherwise formed in a precise and reliable fashion.

FIGS. 6A–6F illustrate an embodiment of the DWP according to the Hays '583 patent. The method provides a partially sacrificial substrate 80 having inner and outer surfaces 80*a*, 80*b*. The partially sacrificial substrate 80 is for example, silicon, however, it can be of any material that can be doped to form a doped region 82 such as a gallium arsenide, germanium, selenium, and others. A portion of the partially sacrificial substrate 80 is doped such that the partially sacrificial substrate 80 includes both the doped region 82, adjacent the inner surface 80*a*, and an undoped sacrificial region 84, adjacent the outer surface 80*b*. The partially sacrificial substrate 80 is doped with a dopant to a predetermined depth relative to the inner surface, such as 10 microns. The dopant may be introduced into the partially sacrificial substrate 80 by a diffusion method as commonly known in the art. However, the doping is not limited to this technique and thus, the doped region 82 adjacent to the inner surface 80*a* of the partially sacrificial substrate 80 may be formed by any method known in the art. Further, the partially sacrificial substrate 80 is doped with a boron dopant on any other type dopant that forms a doped region within the partially sacrificial substrate.

A support substrate 86 is formed of a dielectric material, such as a Pyrex RTM glass, such that the support substrate 86 also electrically insulates the MEMS device. However, the support substrate 86 may be formed of any desired material, including a semiconductor material. In contrast to the DWP described by the Greiff et al. '568 patent, according to the Hays '583 patent sections of the support substrate 86 are etched such that mesas 88 are formed that extend outwardly from the inner surface 86*a* of the support substrate 86. Etching is continued until the mesas 88 are the desired height.

Figure 6A:
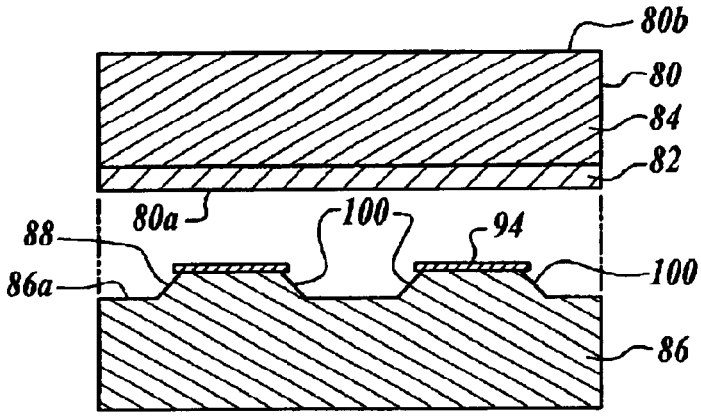
Fig. 6A. (PRIOR ART)
FIGS. 6A–6F illustrate another known Dissolved Wafer Process (DWP) for manufacturing MEMS devices using conventional semiconductor fabrication techniques.
Figure 6B:
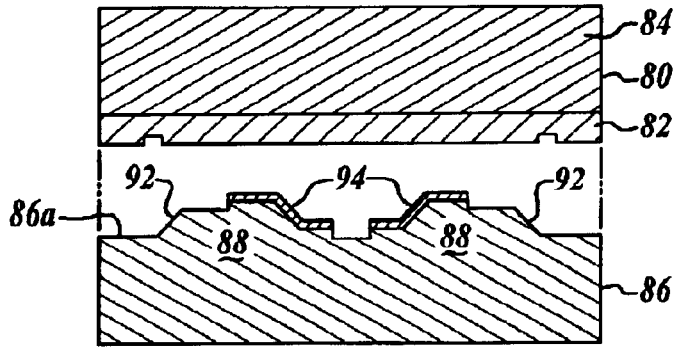
Fig. 6B. (PRIOR ART)
Figure 6C:
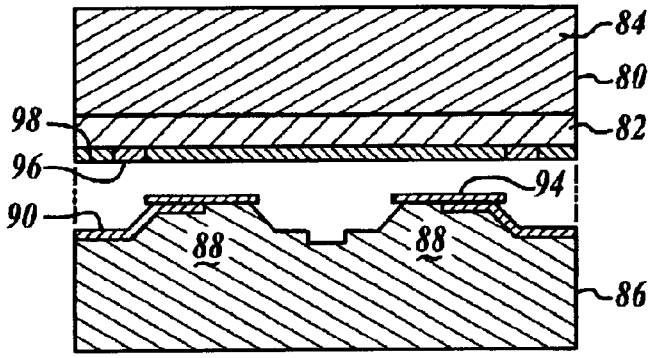
Fig. 6C. (PRIOR ART)

FIGS. 6B and 6C illustrate that after the mesas 88 are formed on the support substrate 86, a metallic material is deposited on an inner surface 86*a* of the support substrate 86 and on the mesas 88 to form electrodes 90. The mesas 88 may be first selectively etched to define recessed regions in which the metal may be deposited so that the deposited metal electrodes 90 do not extend too far above the surface of the mesas 88. In FIG. 6B exposed portions of the inner surface 86*a* of the support substrate 86 are etched, such as by means of BOE, to form recessed regions 92 in the predefined pattern.

In FIG. 6C a metallic electrode material is deposited in the etched recesses 92 to form electrodes 90 and conductive traces (not shown), while contacts 94 project above the mesas 88. As known in the art, the contacts 94, electrodes 90 and traces may be formed of any conductive material, such as a multilayered deposition of titanium, platinum, and gold, and may be deposited by any suitable technique, such as sputtering.

In FIG. 6C the inner surface 80*a* of the partially sacrificial substrate 80 is etched to separate or otherwise form the mechanical and/or electromechanical members of the resulting MEMS device. Forming the mesas 88 in the support substrate 86 causes at least those portions of the inner surface 80*a* of the partially sacrificial substrate 80 to be planar, which facilitates the precise formation of the mechanical and/or electromechanical members of the resulting MEMS device.

Figure 6D:
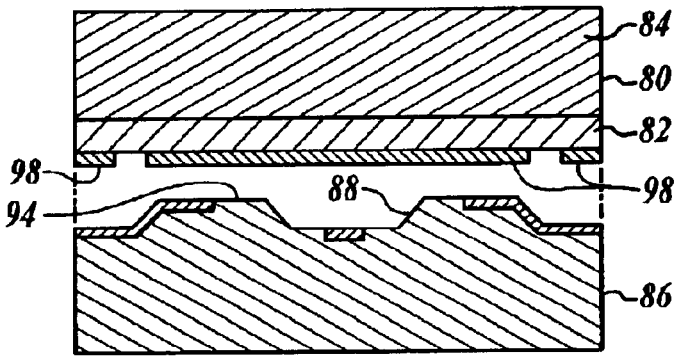
Fig. 6D. (PRIOR ART)

FIGS. 6C and 6D illustrate the mechanical and/or electromechanical members of the resulting MEMS device being formed by coating the inner surface 80*a* of the partially sacrificial substrate 80 with a photosensitive layer of material 94. After exposure, portions 96 of the photosensitive layer 94 are removed leaving remaining portions 98 of the photosensitive layer to protect regions of the inner surface 80*a* of the partially sacrificial substrate 80 which are not to be etched.

Figure 6E:
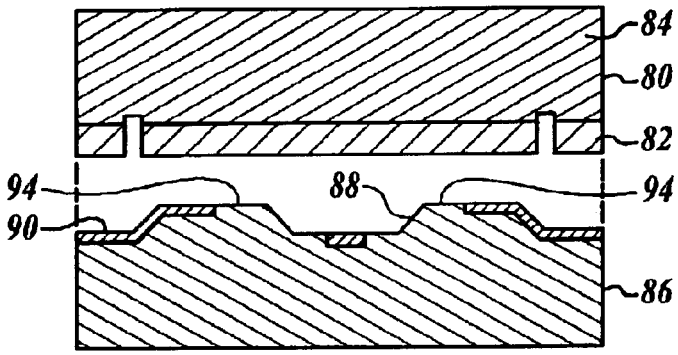
Fig. 6E. (PRIOR ART)

FIG. 6E illustrates that the exposed portions of the inner surface 80*a* of the partially sacrificial substrate 80 are etched, such as by RIE etching, to form trenches through the doped region 82 of the partially sacrificial substrate 80. As described below, the doped region 82 of the partially sacrificial substrate 80 that extends between the trenches will form the resulting mechanical and/or electromechanical member(s) of the MEMS device. After the mechanical and/or electromechanical members of the MEMS device have been defined by the etched trenches, the method of the Hays '583 patent removes the remaining photosensitive material 98 from the inner surface 80*a* of the partially sacrificial substrate 80.

Figure 6F:
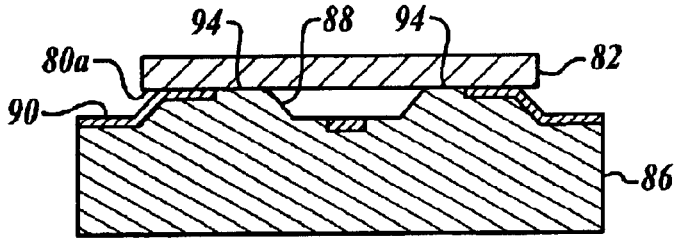
Fig. 6F. (PRIOR ART)

FIG. 6F illustrates placing the inner surface 80*a* of the partially sacrificial substrate 80 in contact with the mesas 88, including the contact electrodes 94 deposited on the surface of the mesas. A bond is formed between the partially sacrificial substrate 80 and the mesas 88, such as an anodic bond or any type that provides a secure engagement.

The undoped sacrificial region 84 of the partially sacrificial substrate 80 may be remove such that the mechanical and/or electromechanical members can rotate, move, and flex. This technique is commonly referred to as the dissolved wafer process (DWP). The removal of the undoped sacrificial region 84 is typically performed by etching it away such as with an ethylenediamine pyrocatechol (EDP) etching process, however, any doping-selective etching procedure may be used.

Removal of the undoped sacrificial region 84 of the partially sacrificial substrate 80 allows the mechanical and/or electromechanical members etched from the doped region 82 to have freedom of movement so as to move or flex in relation to the support substrate 86. In addition, removal of the undoped sacrificial region 84 also disconnects the mechanical and/or electromechanical members from the remainder of the doped region 82 of the partially sacrificial substrate 80 outside of the trenches etched through the doped region.

As shown in FIGS. 6A and 6F, the mesas 88 have a contact electrode surface 94 that extends between a set of sidewalls 100 that may be sloped, which allows the metal electrodes 90 to be deposited on both the contact surface and at least one sidewall of the mesa 88 by "stepping" metal up the sidewall 100 to the contact surface 94. Although the sloped sidewalls 100 are shown as a paired set of sloped sidewalls, in some applications only one of the sidewalls 100 of the set may be sloped. The mesas 88 may assume any geometric form such as a frusto pyramidal shape, but may have cross-sectional shapes such as hexagonal, octagonal, cylindrical, or other useful shapes as needed for a particular application.

As discussed previously, MEMS devices are used in a wide variety of applications. In addition to known MEMS devices, the thermal switch 26 of the present invention is also a MEMS device, resulting from the DWP illustrated herein.

Figure 7:
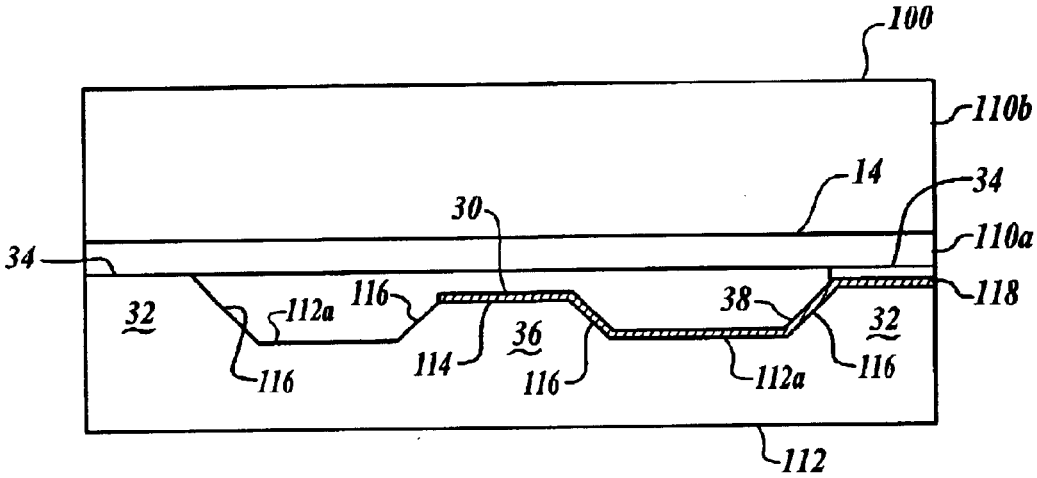
FIG. 7 illustrates the thermal switch of the invention fabricated as a MEMS device using a known DWP fabrication technique.

FIG. 7, for example, illustrates the thermal switch 26 fabricated as a MEMS device using the DWP fabrication techniques described herein. When formed as a MEMS device using a DWP, the resulting MEMS thermal switch device 26 of the present invention includes a semiconductive substrate 110 having the actuator base structure 14 initially formed in epitaxial silicon layer 110*a* on a first inner surface and an undoped sacrificial region 110*b*. As discussed earlier, the semiconductive substrate 110 can be formed of silicon, gallium arsenide, germanium, selenium or the like. The actuator base structure 14 is, for example, an epitaxial beam that is initially shaped into an arched or curved configuration by heating, applying a dissimilar metal to one surface, or selective doping. When the actuator base structure 14 is arched or curved by selective doping, a doped layer is grown epitaxially onto the first substrate 110 rather than by diffusing a dopant into the substrate. Alternatively, such doping may be accomplished by conventional thermal diffusion techniques. However, doping the substrate as deeply or as heavily as desired is often difficult, and the composition and boundaries of the layers thus formed are not easily controlled. The dopant is boron or another dopant such as indium, thallium, or aluminum.

After the actuator base structure 14 is formed in the epitaxial layer 110*a* of the semiconductive substrate 110, the bimodal thermal actuator 12 is formed by applying the cooperating thermal driver structure 16 to the beam-shaped epitaxial actuator base structure 14. As discussed above, the thermal driver material is one of an oxide, a nitride, or tungsten and is selected as a function of the desired thermal response. At least a central portion of the base epitaxial beam 14 is left clear of the material forming the thermal driver 16, which operates as the central electrode 18*a*, while the body of the semiconductive epitaxial beam 14 operates as the conductive path 18*b* to the outer mounting portion 22 for connection in a circuit. The base epitaxial beam 14 may be doped with an electrically conductive material such as boron, indium, thallium, or aluminum, to form the central electrode 18*a* and the conductive path 18*b*. Alternatively, a metallic electrode material, such as a multilayered deposition of titanium, platinum, and gold, is deposited on the inner concave surface 24 of the central mobile portion 20 to form the central electrode 18*a* and the conductive traces 18*b*.

The MEMS thermal switch device 26 of the present invention further includes a support substrate 112 in which is formed the micromachined support plate 28. The support substrate serves to suspend the semiconductive substrate 110, such that the electromechanical parts defined by the semiconductive substrate 110 have increased freedom of movement or flex for "snapping" between the first and second states of stability. However, in the MEMS thermal switch device 26 the support substrate 112 also performs the function electrically insulating the electromechanical parts of the MEMS thermal switch device 26. The support substrate 112 is thus formed of a dielectric material, such as Pyrex RTM. glass.

The MEMS thermal switch device 26 of the present invention and, more particularly, the support substrate 112 further includes at least the pair of mesas 32, which extend outwardly from the remainder of the support substrate 112 and serve to support the semiconductive substrate 110. As discussed previously, because the mesas 32 are formed on the support substrate 112, i.e., in the micromachined support plate 28, as opposed to the semiconductive substrate 110, the inner surface of the semiconductive substrate 110 remains highly planar to facilitate precise and controlled etching of the trenches through the doped region 110*a*. As described above, the mesas 32 each include a contact surface 34 that supports the inner surface 110*a* of the semiconductive substrate 110 such that the semiconductive substrate is suspended over the remainder of the support substrate 32.

The contact electrode 30 and electrical conductor(s) 38 to provide electrical connection with the central electrode 18*a* of the thermal actuator 12, and an electrical connection path, respectively. Alternatively, the inner surface 112*a* of the support substrate 112 is doped with an electrically conductive material such as boron, indium, thallium, or aluminum, or the support substrate 112 is formed of a semiconductor material, such as silicon, gallium arsenide, germanium, or selenium.

The mesa 36 is optionally formed on the inner surface 112*a* of the support substrate 112 with the contact electrode 30 formed on a contact surface 114 aligned with the central electrode 18*a* of the thermal actuator 12. The mesa 36 may be spaced slightly below the support mesas 32 to provide space for the thermal actuator 12 to flex between its first and second states of stability, but is sufficiently close to the plane of the mesas 32 that contact with the electrode portion 18*a* is ensured when the thermal actuator 12 is disposed in the second state of stability, whereby the inner concave surface 24 of the central mobile portion 20 is inverted to an outer convex surface 24 spaced a distance away from the plane P of the border portion 22.

The mesas 32, 36 each optionally include one or more sloped sidewalls 116 extending between the inner surface 112*a* of the support substrate 112 and support surfaces 34, 114. The electrodes are deposited on the contact surfaces 114, 34 and at least one of the sloped sidewalls 116 of the central mesa 36 and at least one of the support mesas 32. The resulting electrodes forming the electrical conductor(s) 38 are therefore exposed on the sidewalls of the respective mesas to facilitate electrical contact therewith. While the contact electrode 30 is exposed on the surface of the central mesa 36, the mesa(s) 32 are first selectively etched to define recessed regions in which the electrode metal is deposited so that the deposited metal electrodes forming the electrical conductor(s) 38 do not extend above the surface of the mesa(s) 32. As illustrated, exposed portions of the inner surface 112*a* of the support substrate 112 are etched, such as by means of BOE, to form recessed regions 118 in the predefined pattern. As described above, the contact surfaces 34 of the mesas 32 support the inner surface 110*a* of the semiconductive substrate 110, i.e., the border portion 22 of the thermal actuator 12.

Figure 8:
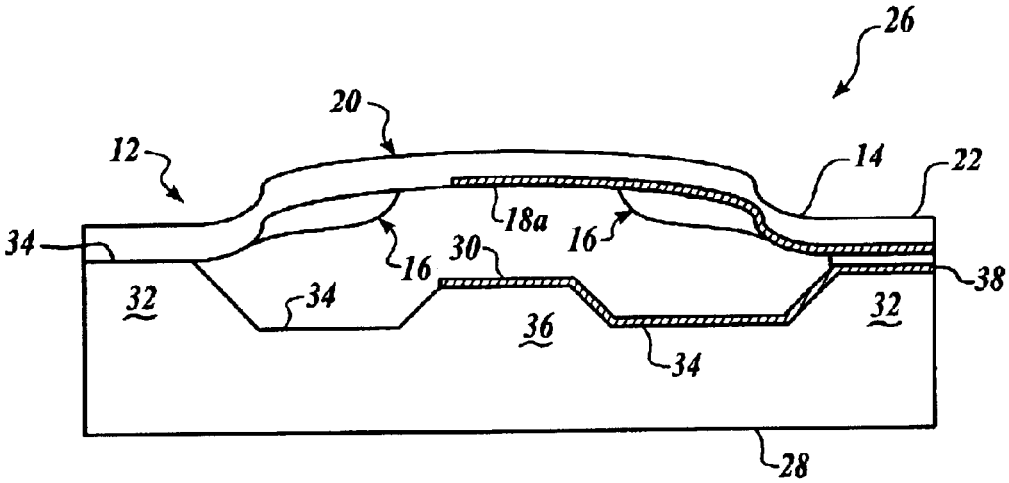
FIG. 8 illustrates combining the bimodal thermal actuation device of the invention embodied as the multilayered thermal actuator shown in FIG. 1 with the micromachined support plate of the invention.

In FIG. 8, after the bimodal thermal actuator 12 is formed, the contact surfaces 34 of the mesas 32 and the inner surface of the semiconductive substrate 110*a* are bonded or otherwise joined at the border portion 22 of the thermal actuator 12 with the central electrode 18*a* aligned with the contact 30 in the micromachined support plate 28. For example, the contact surfaces 34 of the mesas 32 and the inner surface of the semiconductive substrate 10*a* can be bonded by an anodic bond or the like.

In use the switch 26 is coupled to drive a switching means, for example the solid state relay 40, for switching a relatively high load when the MEMS thermal switch actuator 12 switches between its first and second states of stability. Both the MEMS thermal actuator 12 and the solid state relay 40 are co-packaged to save cost and size.

Other bulk micro-machining processes similar to those used to manufacture the Honeywell SiMMA™ accelerometer could also be used, such as Silicon-On-Oxide (SOI) manufacture using the oxide layer as the bi-material system could be desirable).

Figure 9:
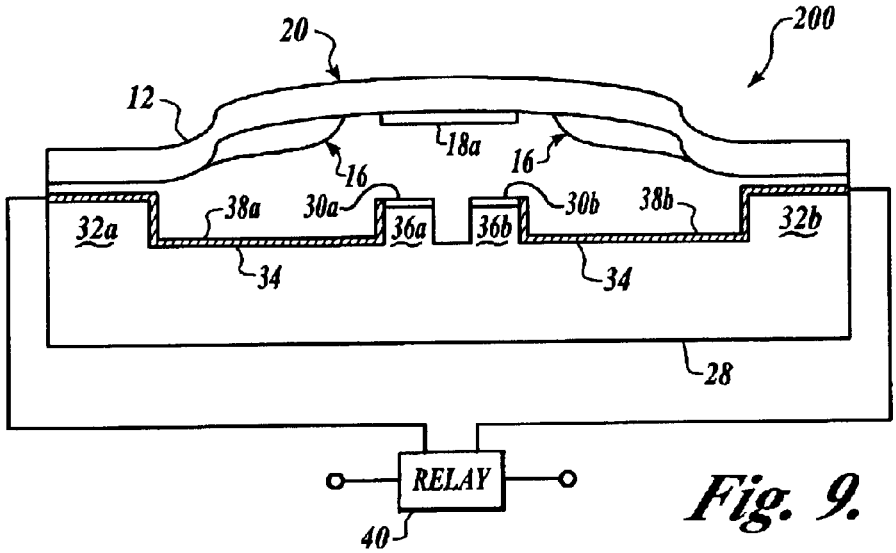
FIG. 9 illustrates the MEMS thermal switch of the invention embodiment as a double contact thermal switch having a bifurcated central contacts and with the bimodal thermal actuation device of the invention configured in a first state of stability.
Figure 10:
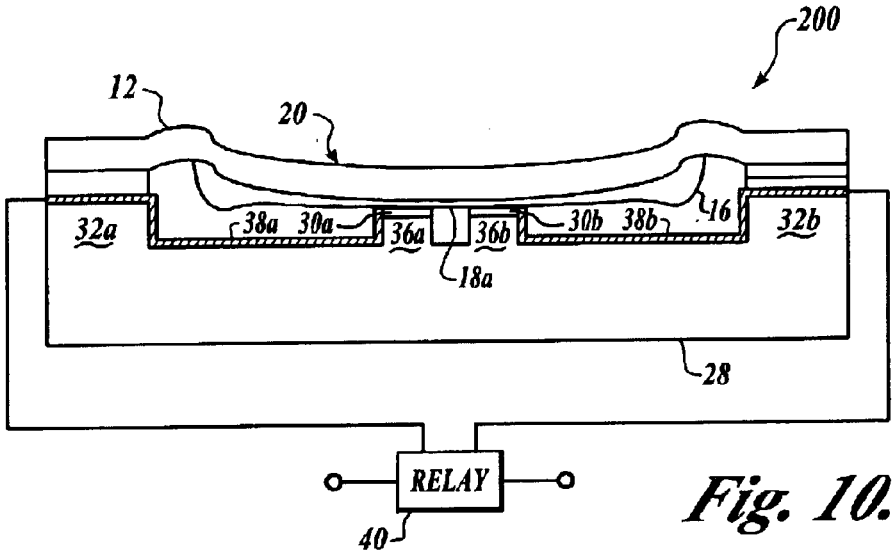
FIG. 10 illustrates the MEMS thermal switch of the invention as embodied in FIG. 9 and having the bimodal thermal actuation device of the invention configured in a second state of stability that is inverted from the first state.

FIG. 9 illustrates the MEMS thermal switch of the invention in an alternative embodiment as a double contact thermal switch 200 having a bifurcated central mesa 36 having mutually isolated electrical contacts 30*a*, 30*b*, each being independently coupled to respective mutually isolated conductive traces 38*a*, 38*b* formed on the inner surface of the support 28 at the floor 34 and led out over the respective mesas 32*a*, 32*b* in recessed regions in which the electrode metal is deposited so that the deposited metal electrodes forming the electrical conductors 38*a*, 38*b* do not extend above the surface of the mesas 32*a*, 32*b*. Alternatively, the support 28 is doped in a similar pattern with an electrically conductive material such as boron, indium, thallium, or aluminum, or is formed of a semiconductor material, such as silicon, gallium arsenide, germanium, or selenium. As illustrated in FIG. 10, the driver structure 16, when formed of a suitably electrically conductive material, may also provide the contact electrode 18*a* on the central mobile portion 20 of the actuator 12. The actuator 12 is provided with at least the central contact electrode 18*a* that is large enough to contact the two otherwise mutually isolated electrical contacts 30*a*, 30*b* when the actuator 12 snaps through to its inverted state, thereby closing a circuit interrupted by the break between the two electrical contacts 30*a*, 30*b*, as shown in FIG. 10.

Figure 11:
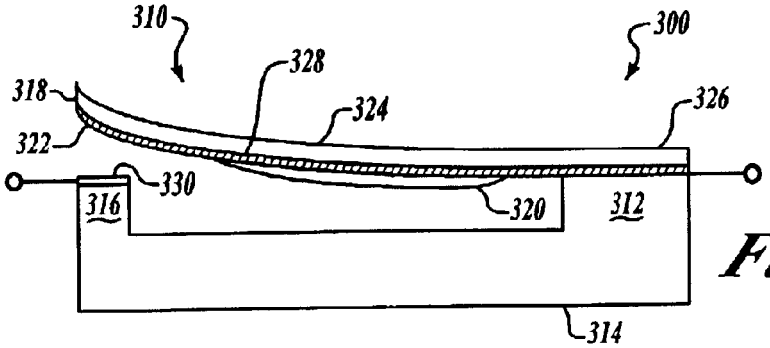
FIG. 11 illustrates the MEMS thermal switch of the invention alternatively embodied as a single contact thermal switch having a cantilevered bimodal thermal actuation device.

FIG. 11 illustrates the MEMS thermal switch of the invention in an alternative embodiment as a single contact thermal switch 300 having a cantilevered thermal actuator 310 secured to a mesa 312 formed in a support plate 314 and aligned with a second contact mesa 316 also formed in the support plate 314 and spaced away from the cantilever support mesa 312. The cantilevered thermal actuator 310 includes an actuator base structure 318 shaped as a curved or arched beam in combination with a cooperating thermal driver structure 320 and an electrical conductor portion 322 at the end opposite the cantilever connection. The material of the actuator base structure 318 is selected from the family of strong and substantially non-ductile materials discussed above and having a first or base thermal expansion rate. For example, the base material is epitaxial silicon or another suitable non-ductile material that is configurable using known microstructuring techniques. Using one of a number of processing techniques discussed above, the base structure 318 is initially shaped into a configuration having a central mobile arched or curved portion 324 that is bordered on one end by a mounting portion 326 on the other end by the conductor electrode 322. The thermal driver structure 320 is provided by application of a thermal driver material that is deposited in a thin layer on the one of the concave or convex surfaces of the arched or curved portion 324 of the base structure 318, depending upon the particular thermal response desired. For example, the thin layer of driver material is deposited at the central mobile portion 324 between the borders, i.e., the electrode and mounting portions 322, 326, at the outer edges of the base structure 318.

The thermal driver material is another material selected from the family of strong and substantially non-ductile materials having a high shear modulus of elasticity and being suitable for use in forming the actuator base structure 318, as discussed above. Furthermore, the driver material is different from the particular material used in forming the actuator base structure 318 and has a second or driver thermal coefficient of expansion that results in a drive thermal expansion rate different from the base thermal expansion rate. For example, when the actuator base structure 318 is formed of epitaxial silicon, the thermal driver structure 320 is formed of silicon oxide, silicon nitride or another suitable material having a thermal coefficient of expansion different from epitaxial silicon.

The conductor electrode 322 and one or more conductive traces 328 are formed on the inner convex surface of the actuator base structure 318, with the conductive circuit. Alternatively traces 328 led to the outer mounting portion 326 for connection in a, the electrical conductor portions 322, 328 are provided by suitably doping the actuator base structure 318 with an electrically conductive material such as boron, indium, thallium, or aluminum. Forming the actuator base structure 318 of a semiconductor material, such as epitaxial silicon, gallium arsenide, germanium, or selenium, obviates the need to provide separate electrical conductor portions 322, 328.

The support plate 314 is formed in a support substrate, for example a glass substrate as described above, having the support mesa 312 and contact mesa 316. The contact mesa 312 includes a contact electrode 330 that is aligned with the conductor electrode 322 of the cantilevered thermal actuator 310 and is coupled for transmitting an electrical signal in an electrical circuit.

As shown in FIG. 11, in a first state of stability the arched portion 324 of the actuator base structure 318 spaces the contact portion 322 away from the contact electrode 330 of the support plate 314. When the bimodal actuator 310 reaches a predetermined set-point temperature, the stresses generated by the difference in thermal coefficients of expansion cause the central mobile portion 324 of the actuator base structure 318 to snap through to a second state of stability (not shown) with the convex curve inverted to a concave configuration. According to this second state of stability, the inverted concave configuration of the central mobile portion 324 forces the conductor portion 322 of the thermal actuator 310 into electrical contact with the contact electrode 330 of the support plate 314, thereby closing a circuit. The characteristic of the thermal actuator 310 of snapping into a different state of concavity at a predetermined threshold or set-point temperature is thus used in the thermal switch 300 to open or close the electrical contacts 322, 330 to signal that the set-point has been reached.

While the preferred embodiment of the invention has been illustrated and described, it will be appreciated that various changes can be made therein without departing from the spirit and scope of the invention.

What is claimed is:

1. A bimodal thermal actuator, comprising:

an actuator base structure formed of only a single layer of a first substantially non-ductile material having a first coefficient of thermal expansion, the actuator base structure having a relatively mobile portion and a substantially stable mounting portion extending therefrom;

a cooperating thermal driver structure formed of only a single layer of a second substantially non-ductile material and having a second coefficient of thermal expansion different from the first coefficient of thermal expansion, the thermal driver structure being joined to at least a portion of the mobile portion of the actuator base structure; and an electrical conductor portion formed on the mobile portion of the actuator base structure.

2. The bimodal thermal actuator of claim 1 wherein at least one of the first and second substantially non-ductile materials is selected from a family of materials having a high ultimate strength and a high shear modulus of elasticity.

3. The bimodal thermal actuator of claim 1 wherein the mobile portion of the actuator base structure is formed in an arcuate shape.

4. The bimodal thermal actuator of claim 1 wherein the cooperating thermal driver structure is formed as a thin layer of the second substantially non-ductile material joined only to a portion of the mobile portion of the actuator base structure adjacent to the substantially stable mounting portion thereof.

5. The bimodal thermal actuator of claim 1 wherein the electrical conductor portion is formed as a portion of the mobile portion that is doped with electrically conductive material.

6. The bimodal thermal actuator of claim 1 wherein the electrical conductor portion is formed of a third material different from the first and second non-ductile materials as a metallic electrode at a central portion of the mobile portion.

7. The bimodal thermal actuator of claim 1, further comprising:

a support base having an upright mesa and an electrode formed on one surface;

and wherein the mounting portion of the bimodal thermal actuator is coupled to the mesa with the electrical conductor portion of the mobile portion aligned with the electrode on the support base.

8. A bi-stable thermal actuator, comprising:

a single first and a different single second conjoined layers of non-ductile materials having different first and second thermal expansion coefficients, the layer of the first material being formed with a substantially planar flange portion along one edge and a relatively mobile arcuate portion extending therefrom and having an electrically conductive portion formed of a material different from the first and second conjoined single layers of non-ductile materials and situated along one surface, and the layer of the second material being joined with a portion of the arcuate portion of the layer of the first material; and wherein:

the relatively mobile arcuate portion is further disposed subsequently in a plurality of stable relationships to the flange portion, one stable relationship of the relatively mobile arcuate portion to the flange portion positioning the surface having the electrically conductive portion on a first side of the substantially planar flange portion, and another stable relationship of the relatively mobile arcuate portion to the flange portion positioning the surface having the electrically conductive portion on a second side of the substantially planar flange portion opposite from the first side.

9. The bi-stable thermal actuator of claim 8 wherein each of the first and second non-ductile materials are selected from a group of materials that comprises glass, silicon, silicon oxide, and tungsten.

10. The bi-stable thermal actuator of claim 8 wherein the layer of second material is joined only with a portion of the arcuate portion adjacent to the planar flange.

11. The bi-stable thermal actuator of claim 8 the layer of the first material is formed as an epitaxial layer of material.

12. The bi-stable thermal actuator of claim 11 wherein the electrically conductive portion is doped with an electrically conductive material.

13. The bi-stable thermal actuator of claim 8 further comprising:

a base portion being formed with an electrical contact and a means for securely the flange portion of the bi-stable thermal actuator with the electrically conductive portion aligned with the electrical contact, and wherein;

the relatively mobile arcuate portion is further disposed subsequently in a plurality of stable relationships to the base portion, in one stable relationship the relatively mobile arcuate portion to the base portion the electrically conductive portion being spaced away from the electrical contact, and in another stable relationship of the relatively mobile arcuate portion to the base portion the electrically conductive portion being in contact with the electrical contact of the base portion.

14. The bi-stable thermal actuator of claim 13 wherein:

the layer of the first material further comprises a substantially planar flange portion along each of two edges on opposite sides of the relatively mobile arcuate portion; and the electrically conductive portion is situated intermediate between the two edges.

15. A bi-stable thermal actuator, comprising:

an actuator base structure formed in only a single layer of epitaxial silicon, the actuator base structure being formed with a central mobile portion extending from a substantially planar border portion and including a surface area doped with an electrically conductive material; and a single layer of driver material joined to a surface of the mobile portion of the actuator base structure, the driver material being selected from a group of substantially non-ductile material and having a thermal expansion rate different from that of epitaxial silicon.

16. The bi-stable thermal actuator of claim 15 wherein the mobile portion is further disposed subsequently in a plurality of stable relationships to the border portion as a function of temperature, a first stable relationship of the mobile portion to the border portion positioning the surface having the doped area on a first side of the border portion, and a second stable relationship of the mobile portion to the border portion positioning the surface having the doped area on a second side of the border portion opposite from the first side.

17. The bi-stable thermal actuator of claim 16, further comprising:

a glass substrate having substantially planar and parallel opposing offset upper and lower surfaces, an upright mesa extending from the upper surface and an electrode spaced away from the mesa; and wherein the border portion of the actuator base structure is bonded to the mesa with the doped area of the mobile portion aligned with the electrical contact such that the doped area is spaced away from the electrode when the mobile portion is in the first stable relationship to the border portion, and the doped area is in electrical contact with the electrode when the mobile portion is in the second stable relationship to the border portion.

18. The bi-stable thermal actuator of claim 17 wherein:

the glass substrate further comprises a second upright mesa extending from the upper surface with the electrode being spaced intermediate between the first and second mesas; and the actuator base structure further comprises a second substantially planar border portion with the doped area being spaced intermediate between the first and second border portions, the second border portion being bonded to the second mesa.

19. A thermal switch, comprising:

a support plate being formed with an upright mesa and an electrical contact;

a bi-stable element formed of only conjoined first and second single layers of substantially non-ductile materials having different first and second thermal expansion rates, the first single layer having a relatively mobile arcuate portion with an electrically conductive portion and being bordered by a relatively planar portion, the relatively planar portion of the bi-stable element being joined to the mesa of the support plate with the electrically conductive portion of the bi-stable element being aligned with the electrical contact of the support plate; and wherein the relatively mobile portion of the bi-stable element is further disposed in one stable relationship with the support plate having the electrically conductive portion spaced away from the electrical contact of the support plate, and another stable relationship having the electrically conductive portion making an electrical connection with the electrical contact.

20. The thermal switch of claim 19 wherein the first layer of the bi-stable element is a layer of epitaxially grown material.

21. The thermal switch of claim 19 wherein the first layer of the bi-stable element is a layer of material selected from a group of materials that are configurable using known microstructuring techniques.

22. The thermal switch of claim 19 wherein the second single layer is further conjoined with the first single layer only along a portion of the mobile portion.

23. The thermal switch of claim 19 wherein:

the support plate further comprises first and second upright mesas spaced on either side of the electrical contact; and the mobile portion of the bi-stable element is bordered by two relatively planar portions with the electrically conductive portion substantially centered therebetween and of the planar portions being joined to a respective one of the first and second upright mesas.

24. A method for determining temperature, the method comprising:

joining only two single layers of substantially non-ductile materials having different coefficients of thermal expansion along a common surface in a bimodal thermal actuator having an actuator portion being mobile relative to a mounting portion and having an electrically conductive area situated at one surface thereof; and wherein the relatively mobile actuator portion is further disposed subsequently in a plurality of stable relationships to the mounting portion as a function of sensed temperature, a first stable relationship of the relatively mobile actuator portion to the mounting portion positioning the electrically conductive area in contact with an electrode, and a second stable relationship of the relatively mobile actuator portion to the mounting portion spacing the electrically conductive area away from the electrode.

25. The method of claim 24 wherein the first stable relationship places the electrically conductive area of the relatively mobile actuator portion on a first side of the mounting portion, and the second stable relationship places the electrically conductive area of the relatively mobile actuator portion on a second side of the mounting portion opposite from the first side.

26. The method of claim 24, further comprising joining the mounting portion of the bimodal thermal actuator in relationship to a support structure including the electrode.

27. The method of claim 24, further comprising forming the relatively mobile actuator portion in an arcuate configuration extending from the mounting portion.

28. The method of claim 24, further comprising:

forming the mounting portion as a pair of spaced apart mounting portions; and forming the relatively mobile actuator portion in an arcuate configuration extending between the pair of spaced apart mounting portions.

* * * * *